US008783488B2

(12) United States Patent
Weber

(10) Patent No.: US 8,783,488 B2
(45) Date of Patent: Jul. 22, 2014

(54) FLUID RESERVOIR

(75) Inventor: Lutz Weber, Zweibrücken (DE)

(73) Assignee: Thinxxs Microtechnology AG, Zweibrücken (DE)

( * ) Notice: Subject to any disclaimer, the term of this patent is extended or adjusted under 35 U.S.C. 154(b) by 0 days.

(21) Appl. No.: 13/383,355

(22) PCT Filed: Jun. 7, 2010

(86) PCT No.: PCT/DE2010/000646

§ 371 (c)(1),
(2), (4) Date: Jan. 10, 2012

(87) PCT Pub. No.: WO2011/006460

PCT Pub. Date: Jan. 20, 2011

(65) Prior Publication Data

US 2012/0187117 A1 Jul. 26, 2012

(30) Foreign Application Priority Data

Jul. 11, 2009 (DE) ..... 10 2009 032 744

(51) Int. Cl.
*B65D 81/26* (2006.01)

(52) U.S. Cl.
CPC ..... *B65D 81/268* (2013.01); *B65D 81/266* (2013.01)
USPC ..... 220/4.12; 220/678

(58) Field of Classification Search
CPC .. B65D 81/268; B65D 81/267; B65D 81/266; B65D 81/26
USPC ..... 220/4.12, 678, 677, 359.4, 359.3, 220/359.2, 359.1, DIG. 34; 215/232; 206/204; 53/454, 453, 452
See application file for complete search history.

(56) References Cited

U.S. PATENT DOCUMENTS

| | | | | | |
|---|---|---|---|---|---|
| 2,566,533 | A * | 9/1951 | Poux | 53/452 |
| 2,705,579 | A * | 4/1955 | Mason | 222/107 |
| 4,236,652 | A * | 12/1980 | Beguhn | 222/92 |
| 4,250,997 | A * | 2/1981 | Bodenmann et al. | 206/528 |
| 4,430,013 | A * | 2/1984 | Kaufman | 401/132 |
| 4,657,159 | A * | 4/1987 | Grant | 222/83 |
| 5,241,149 | A * | 8/1993 | Watanabe et al. | 219/725 |
| 6,264,065 | B1 | 7/2001 | Jouillat | |
| RE37,934 | E * | 12/2002 | Hoffmann | 424/449 |
| 6,880,312 | B2 * | 4/2005 | Kraemer et al. | 53/434 |
| 6,991,095 | B1 * | 1/2006 | Yamasoto et al. | 206/204 |
| 2004/0129800 | A1 | 7/2004 | Duquet | |
| 2007/0068845 | A1 * | 3/2007 | Schuehrer | 206/581 |
| 2007/0158227 | A1 * | 7/2007 | Amano et al. | 206/438 |

FOREIGN PATENT DOCUMENTS

| | | | | |
|---|---|---|---|---|
| CA | 2116997 C | * | 1/1999 | B65D 81/26 |
| WO | 9801360 A | | 1/1998 | |

* cited by examiner

*Primary Examiner* — Robert J Hicks
(74) *Attorney, Agent, or Firm* — Lucas & Mercanti, LLP; Klaus P. Stoffel

(57) ABSTRACT

The invention relates to a fluid reservoir, in particular a fluid reservoir to be integrated into a miniaturized flow cell, comprising a reservoir space, which is enclosed by two bodies (6,7) that lie against each other in a fluid-tight manner. According to the invention, in addition to a stored liquid (9), a solid filling body (12) that fills the remaining reservoir space is arranged in the reservoir space. A part of the reservoir space filled by the stored liquid is preferably bounded predominately by one of the two bodies (6,7) and the solid filling body (12).

20 Claims, 4 Drawing Sheets

FLUID RESERVOIR

The present application is a 371 of International application PCT/DE2010/000646, filed Jun. 7, 2010, which claims priority of DE 10 2009 032 744.4, filed Jul. 11, 2009, the priority of these applications is hereby claimed and these applications are incorporated herein by reference.

BACKGROUND OF THE INVENTION

The invention relates to a fluid reservoir, particularly a fluid reservoir for integration in a miniaturized flow cell, with a reservoir space which is enclosed by two bodies which rest against each other in a fluid-tight manner.

The invention further relates to a method for manufacturing such a fluid reservoir.

Fluid reservoirs of this type are known, for example, as blister reservoirs which can be emptied by deformation. The dome-like reservoir space of such blister reservoirs always contains a certain quantity of residual air which impairs the precise metering of dispensed liquid volumes. The compressible residual air quantity initially ensures a delay of the liquid dispensation. When lowering a manual or mechanical contact pressure acting on the blister, an uncontrolled subsequent fluid discharge occurs because of the tension release of the air quantity. If it is attempted during the manufacture of the reservoir to prevent the injection of residual air by completely filling the reservoir space with the liquid, this results because of the curved liquid meniscus in an undesired displacement of liquid into a gap between the bodies which rest against each other.

SUMMARY OF THE INVENTION

The invention is based on the object of creating a novel fluid reservoir of the above-mentioned type which facilitates a more precise metering of dispensed liquid quantities.

The fluid reservoir according to the invention which meets this object is characterized in that, in addition to a stored liquid, a solid filling body which fills out the remaining reservoir space is arranged in the fluid reservoir.

For manufacturing such a fluid reservoir, an indentation is formed in the first body, the liquid to be stored is filled into the indentation, and the indentation is covered in a fluid-tight manner by a second body while forming the reservoir space, wherein in accordance with the invention, the indentation is only filled partially with the liquid and additionally a solid filling body is placed in the indentation, wherein the filling body completely fills out the reservoir space together with the introduced liquid.

Since liquid and filling bodies completely fill out or almost completely fill out the reservoir space, no residual air cushions can be formed in the reservoir space which would delay or uncontrollably extend the liquid dispensation.

Preferably a portion of the reservoir space filled out by the stored liquid is delimited entirely or predominantly by one of the two bodies and the solid filling body. This means that when the reservoir is manufactured, the surface of the liquid facing the first body is covered entirely or partially by that filling body against which the second body is placed when the reservoir space is closed. In this manner, no liquid meniscus or only a small liquid meniscus is present opposite the second body. Alternatively, a liquid meniscus facing the first body could be pulled so as to be smooth by means of the filling body lowered into the liquid.

Accordingly, when covering the indentation by means of the second body air inclusions in the reservoir space and an undesired displacement of the liquid into the gap between the bodies cannot occur.

Preferably, the two bodies enclosing the reservoir space are not only connected in a fluid-tight manner, possibly under pressure, but are also connected to each other, particularly by welding or/and gluing them together.

In accordance with a preferred embodiment of the invention, the two bodies rest against each other with plane surfaces and the filling body has a surface which is flush with these plane surfaces. When covering the above-mentioned indentation by means of the second body no air inclusion is caused between the two bodies.

At least one of the two bodies can be formed by a foil which can be deformed for emptying the reservoir and, for example, covers an indentation in a thicker plate which forms the reservoir space.

However, in a particularly preferred embodiment of the invention, the foil itself has a bulge forming the reservoir space, so that a reservoir in the form of a blister is created. In particular, two foils form the reservoir, wherein at least one of the foils is deformed. The foils consist, for example, of a synthetic material, aluminum or aluminum coated with synthetic material and are glued or welded together in a fluid-type manner.

In an embodiment of the invention, the filling body is connected to one of the two bodies, particularly integrally connected, wherein the filling body protrudes from one of the bodies into an indentation formed by the other body and forming the reservoir space. When the indentation is covered by the one body, the protruding filling body is placed in the indentation and displaces all air therefrom.

The volume of the reservoir space portion filled out by the liquid may be small in comparison to the total volume of the reservoir space, i.e., by varying the size of the filling body the liquid quantities that can be filled in can be varied with a given total volume of the reservoir space.

The filling body may have a surface adapted to a die for deforming the aforementioned bulge. In this manner, a die which presses the blister bulge together is centered and an undesired formation of wrinkles of the blister foil is prevented.

In accordance with a further development of the invention, the filling body can form a tool for producing an outlet opening which can be actuated by deforming the foil. For example, the filling body may comprise a mandrel or a slide which punches a foil or/and causes an intended breaking point to burst.

The filling body may be a body which melts at room temperature. For example, a piece of ice forming the filling then ensure that a stored aqueous liquid is diluted.

Moreover, the filling body may be provided for an alternating effect with the stored liquid, wherein, in addition to chemical reactions, for example, the pick-up of undesired components from the liquid, such as, for example, particles, oxygen or ions, would be possible.

In a further development of the invention, the filling body has a hydrophilic surface which advantageously facilitates a slight wetting using the stored liquid.

In accordance with a further development of the invention, the filling body can be constructed for receiving gas, wherein it advantageously removes small residual air quantities from the reservoir space. Alternatively, the liquid can be degassed prior to storage, so that it can take in residual air.

It is understood that the filling body may be composed of several parts.

In an especially preferred embodiment, the filling body fills a step-shaped attachment of the bulge. The bulge which is, for example, spherical then does not transmit any forces to the lower foot edge or bulge, when it is being deformed. The formation of an outlet opening by breaking an intended breaking point at the base edge is not impaired.

In accordance with a further preferred embodiment of the invention the filling body comprises gaps, breakthroughs and/or ducts having certain dimensions which are wetted by the liquid to be stored when the filling body is placed in the reservoir and the air is displaced therefrom. When pressing the reservoir, the liquid to be stored is conducted in a controlled manner by means of these contours to the fluidic outlet of the reservoir, such as, for example, a blister channel as known from the prior art.

In accordance with a further embodiment, the flow cell connected to the reservoir can be connected to an injection needle, and the fluid to be stored may be a medicament, wherein emptying of the reservoir for dispensing a medicament is suitable comparable to a syringe. For this purpose, the reservoir space preferably has an oblong shape.

In the following the invention will be explained further with the aid of embodiments and the enclosed drawings which refer to these embodiments. In the drawing:

DETAILED DESCRIPTION OF THE INVENTION

Figure 1:
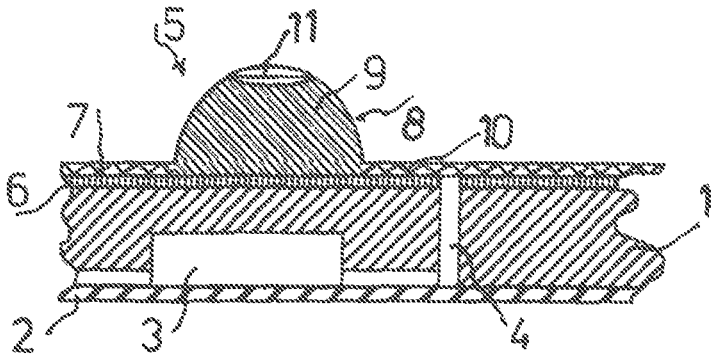
Fig. 1 (PRIOR ART)
FIG. 1 is a partial sectional illustration of a flow cell with an integrated reservoir according to the prior art.

A flow cell partially illustrated in FIG. 1 and in the following figures includes a plastic plate 1 with cavities which are covered by a foil 2 connected to the plastic plate 1. In FIGS. 1 to 5 and in FIG. 7 the cavities can be seen as a chamber 3 and a transport channel 4; in FIG. 6, only a transport channel 27 can be seen.

On a side of the plastic plate 1 facing away from the foil 2 a fluid reservoir each is arranged which comprises two flat foils 6 and 7 which are connected to each other. The foil 6, in turn, is connected on its side facing away from the foil 7 to the plastic plate 1. The foils 6, 7 can be connected to each other and the foil 6 can be connected to the plate 1 by welding or/and gluing and/or by means of a double-sided adhesive film, not shown.

In accordance with FIG. 1, the foil 7 has a spherically shaped bulge 8 which forms between the foils 6, 7 a reservoir space for receiving a liquid 9. By pressing against the bulge 8 at 10, an opening channel leading to the transport channel 4 can be broken open.

As can be seen in FIG. 1, a residual air cushion 11 is formed in the reservoir space. When pressing the bulge 8, the residual air is compressed which, after the intended breaking forming the opening channel 10 has burst, leads to an uncontrolled discharge of liquid from the reservoir space.

Figure 2:
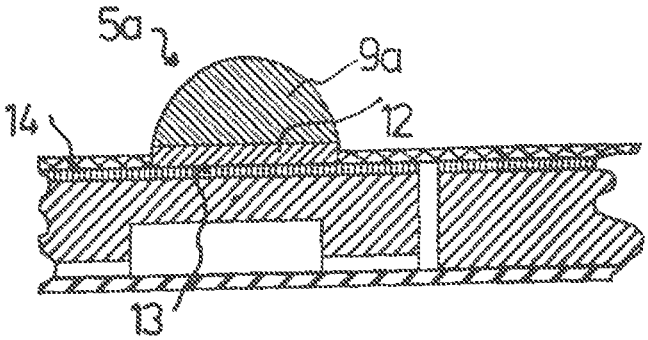
FIG. 2 is a partial sectional illustration of a flow cell with a first embodiment of a reservoir according to the invention.

In the embodiment of FIG. 2 a plate-shaped solid filling body 12 is arranged in the reservoir space of a reservoir 5*a*, which filling body 12, together with a liquid 9*a* contained in the reservoir space, completely fills out the reservoir space. Liquid 9*a* can penetrate only into a narrow gap between the plate border area of the filling body 12 and the wall of the reservoir space. The shape of the edge of the filling body determines the position and size of the gap. A plate surface 13 of the filling body 12 facing the foil 6 is arranged flush with the contact surface 14 formed between the foils 6, 7. In contrast to reservoir 5, no residual air or hardly any residual air is present in the reservoir space of the reservoir 5*a*.

Figure 3:
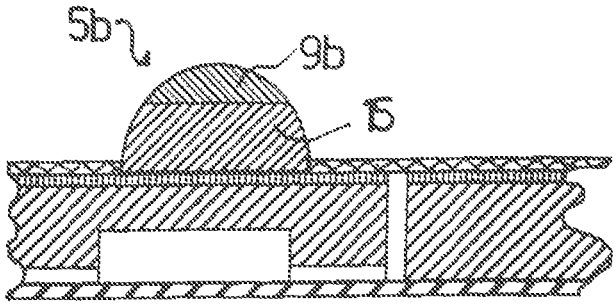
FIG. 3 shows a second embodiment of a reservoir according to the invention with a reservoir volume for liquids which is smaller than that of the reservoir of FIG. 2.

In the same manner, the reservoir space of a reservoir 5*b* shown in FIG. 3 does not contain any residual air. The reservoir 5*b* differs from the reservoir 5*a* in that a filling body 15 is significantly thicker than the plate-shaped filling body 12. Correspondingly, a smaller volume of a liquid 9*b* is enclosed in the reservoir 5*b*. As illustrated in FIG. 3, by varying the plate thickness and geometry, with a given size of the bulge, reservoir spaces of different sizes for liquids can be formed, wherein very small reservoir spaces with exactly measured volumes can also be produced.

Figure 4:
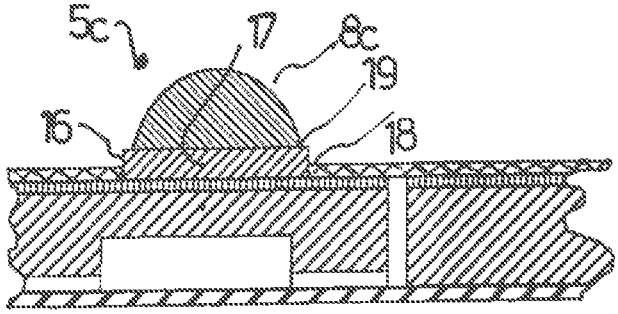
FIG. 4 shows a third embodiment of a reservoir according to the invention with a filling body arranged in a stepped attachment of a blister bulge.

FIG. 4 shows a reservoir 5*c* with a bulge 8*c* which includes a stepped attachment 16. A portion of the reservoir space formed by the stepped attachment 16 is filled out by a plate-shaped filling body 17 whose thickness is between the thickness of the filling body 12 and the thickness of the filling body 15. Because of the stepped attachment, a base point 18 of the bulge 8*c* is laterally offset relative to the base point 19 of a spherically shaped part of the bulge 8*c*, so that a pressure acting on the spherically shaped part is transmitted to the base point 18 reduced by only a weakened extent. The bursting in an intended breaking point present at 18 is not impaired as a result by the pressure acting on the bulge 8*c*.

Figure 5:
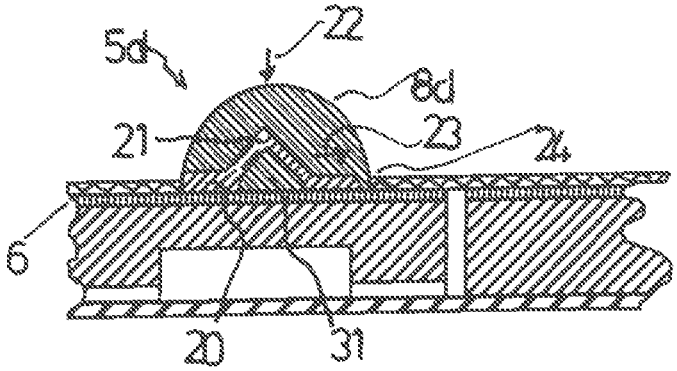
FIG. 5 shows a fourth embodiment for a reservoir according to the invention with a filling body constructed as a slide.

A fluid reservoir 5*d*, as shown in FIG. 5, includes a filling body 20 which is articulated at 21. Therefore by exerting a compressive force against the bulge 8*d* according to arrow 22, a displacement of a portion of the filling body 22 in accordance with arrow 23 takes place, wherein the filling body pushes open an intended breaking point at 24 for forming an outlet opening.

Figure 6:
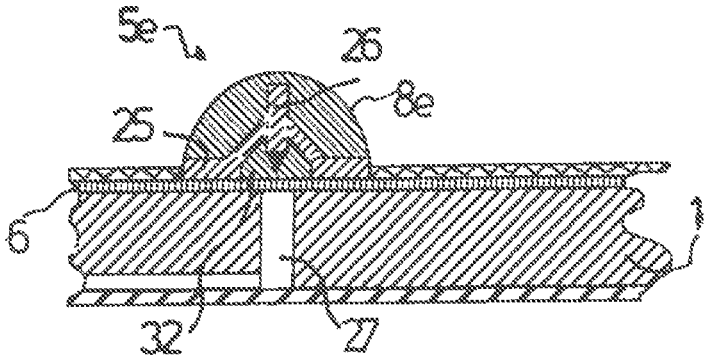
FIG. 6 shows a fifth embodiment of a reservoir according to the invention with a filling body comprising a mandrel.

FIG. 6 shows a reservoir 5*e* with a filling body 25. The filling body 25 comprises a mandrel 26 which, when a compressive force acts on the bulge 8*e* in accordance with arrow 22 (FIG. 5), can be punched through the foil 6 while forming an outlet opening, so that the reservoir 5*e* is in communication with the above-mentioned transport channel 27.

In the embodiments of FIGS. 5 and 6, the liquid contained in the reservoir space contacts the foil 6 only over a relatively small area 31 or 32 which is uncritical in relation to the liquid displacement.

Figure 7:
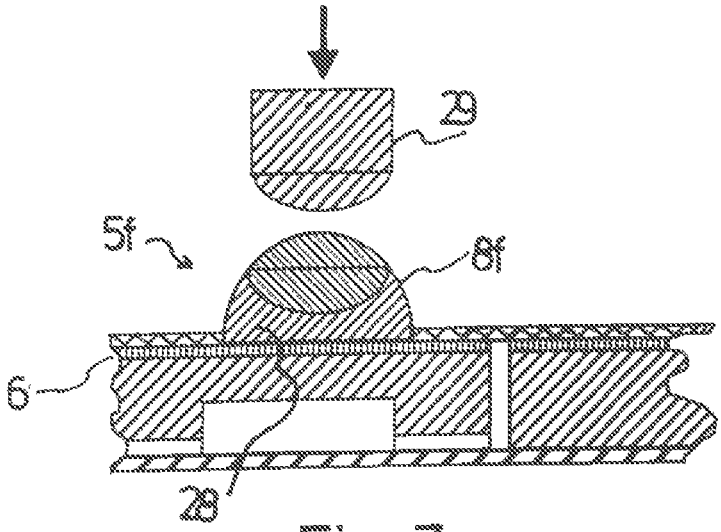
FIG. 7 shows a sixth embodiment of a reservoir according to the invention with a filling body adapted to a pressing die.

A reservoir 5*f* shown in FIG. 7 includes a filling body 28 which on its side facing away from the foil 6 is shaped in accordance with a pressure die 29 for exerting a compressive force against the bulge 8*f*.

Figure 8:
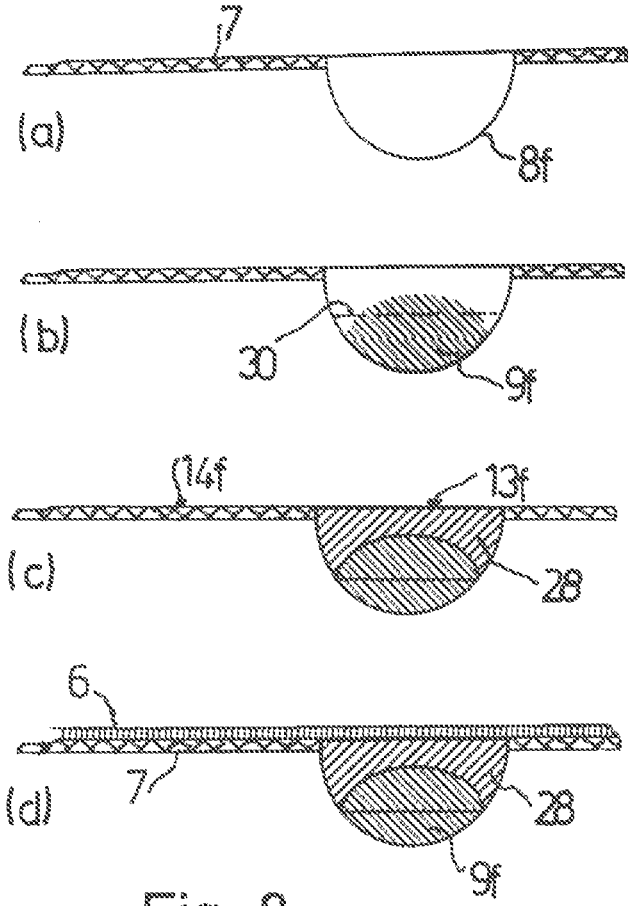
FIG. 8 is an illustration explaining the manufacture of a reservoir according to the invention.

Reference will now be made to FIG. 8 which explains as an example the manufacture of the reservoir 5*f* shown in FIG. 7.

In accordance with FIG. 8*a*, in a first step the bulge 8*f* is made in the foil 7, in the case of a plastic foil, for example, by hot deep drawing, and in the case of an aluminum foil as it is typically used for blisters by cold deep drawing. Liquid 9*f* to be stored is filled into the vessel space formed by the bulge 8*f*. The marking line 30 in FIG. 8*b* indicates the resulting liquid level.

In the following step in accordance with 8*c*, the filling body 28 is then placed in the bulge 8*f*, wherein the surface 13*f* of the filling body 28 facing away from the liquid 9*f* is aligned flush with the surface 14*f* of the foil 7 or protrudes slightly beyond the latter.

In the last step according to FIG. 8*d*, the foil 7 is connected to the foil 6 so as to form a closed reservoir space, wherein the reservoir space is filled out by the liquid 9*f* and the filling body 28 without any residual air.

Figure 9:
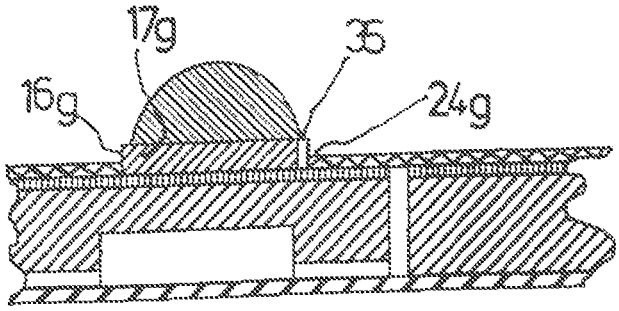
FIGS. 9 and 10 show two additional embodiments of reservoirs according to the invention.
Figure 10:
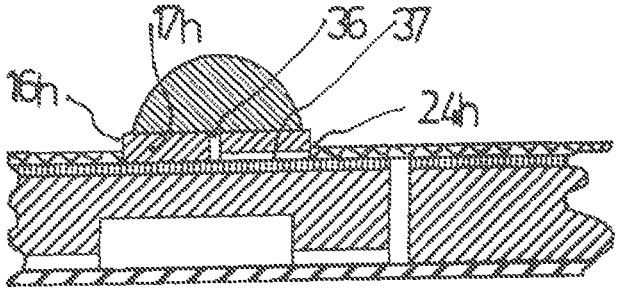

FIGS. 9 and 10 show reservoirs which are similar to the reservoir of FIG. 4 with a stepped attachment 16*g* or 16*h*. A filling body 17*g* arranged in the stepped attachment 16*g* has at the edge a slot 35. When the reservoir is emptied, liquid is conveyed through this slot 35 to an outlet opening of the reservoir 24*g*.

A filling body 17*h* of the reservoir of FIG. 10 has a central passage and a radial channel 37 which leads to a reservoir outlet opening 24*h*.

The invention claimed is:

1. A fluid reservoir in a miniaturized flow cell, comprising: two bodies, one of the bodies having an indentation, the bodies being arranged to rest against each other in a fluid-tight manner so as to enclose a reservoir space in the indentation by covering the indentation in the one body with the other of the bodies; and, a solid filling body arranged in the reservoir space, in addition to a stored liquid, so that the solid filling body fills out a remaining capacity of the reservoir space not occupied by the liquid, and prevents formation of a residual air cushion caused by a curved liquid meniscus when covering the indentation with the other of the bodies, the solid filling body being a separate element from the two bodies.

2. The fluid reservoir according to claim 1, wherein a portion of the reservoir space filled out by the stored liquid is predominately delimited by one of the two bodies and the solid filling body.

3. The fluid reservoir according to claim 1, wherein the two bodies are connected to each other.

4. The fluid reservoir according to claim 3, wherein the two bodies are welded and/or glued together.

5. The fluid reservoir according to claim 1, wherein the two bodies rest against each other in a fluid-tight manner with plane surfaces, and the filling body has a surface that is flush with the plane surfaces.

6. The fluid reservoir according to claim 1, wherein at least one of the two bodies is formed by a foil.

7. The fluid reservoir according to claim 6, wherein the foil has a deformable bulge that forms the reservoir space.

8. The fluid reservoir according to claim 1, wherein the filling body is connected to one of the two bodies, and protrudes from the one body into the indentation forming the reservoir space.

9. The fluid reservoir according to claim 1, wherein a volume of a portion of the reservoir space filled out by the stored liquid is small in relation to a total volume of the reservoir space.

10. The fluid reservoir according to claim 7, wherein the filling body has a surface adapted to a die for deforming the bulge for pressing out the stored liquid.

11. The fluid reservoir according to claim 7, wherein the filling body forms a tool for producing an outlet opening, wherein the tool can be actuated by deforming the bulge.

12. The fluid reservoir according to claim 11, wherein the filling body comprises a mandrel and/or forms a slide.

13. The fluid reservoir according to claim 1, wherein the filling body is a body which melts at room temperature.

14. The fluid reservoir according to claim 1, wherein the filling body interacts with the liquid.

15. The fluid reservoir according to claim 1, wherein the filling body has a hydrophilic surface.

16. The fluid reservoir according to claim 1, wherein the liquid is at least partially degassed prior to inclusion in the reservoir space.

17. The fluid reservoir according to claim 1, wherein the filling body is suitable for picking up residual air.

18. The fluid reservoir according to claim 1, wherein the filling body is constructed of several parts.

19. The fluid reservoir according to claim 7, wherein the reservoir space has a stepped attachment that is filled out by the filling body up to a border area.

20. The fluid reservoir according to claim 1, wherein the filling body has a breakthrough, channel or a slot for conducting the liquid to a reservoir outlet.

* * * * *